US010215480B2

(12) United States Patent
Biotti et al.

(10) Patent No.: US 10,215,480 B2
(45) **Date of Patent: *Feb. 26, 2019**

(54) METHOD FOR CONTROLLING A REFRIGERATING UNIT

(71) Applicant: WHIRLPOOL CORPORATION, Benton Harbor, MI (US)

(72) Inventors: Carolina Biotti, Comerio (IT); Raffaele Paganini, Comerio (IT); Sankara Pandian, Comerio (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/889,489

(22) Filed: Feb. 6, 2018

(65) Prior Publication Data

US 2018/0164032 A1 Jun. 14, 2018

Related U.S. Application Data

(63) Continuation of application No. 14/686,167, filed on Apr. 14, 2015, now Pat. No. 9,933,204.

(30) Foreign Application Priority Data

Apr. 14, 2014 (EP) ..... 14164547

(51) Int. Cl.
*F25D 29/00* (2006.01)

(52) U.S. Cl.
CPC ..... *F25D 29/00* (2013.01); *F25B 2600/025* (2013.01); *F25D 2400/36* (2013.01)

(58) Field of Classification Search
CPC ..... F25D 29/00; F25D 2400/36; F25D 2600/025; F25D 23/12; G01N 1/42; G01N 1/02
See application file for complete search history.

(56) References Cited

U.S. PATENT DOCUMENTS 5,816,054 A * 10/1998 Yoo ..... F25B 5/04 62/80
6,631,620 B2 10/2003 Gray et al.
6,739,146 B1 5/2004 Davis et al.
6,817,195 B2 11/2004 Rafalovich et al.
7,055,338 B2 6/2006 Ergarac et al.
7,100,387 B2 9/2006 Boer et al.
7,481,068 B2 1/2009 King et al.
7,596,432 B2 9/2009 Boer et al.
7,665,317 B2 2/2010 Boer et al.
7,757,501 B2 7/2010 Boer et al.
7,895,851 B2 3/2011 Bianchi et al.
(Continued)

*Primary Examiner* — Kun Kai Ma
(74) *Attorney, Agent, or Firm* — Price Heneveld LLP

(57) ABSTRACT

A method for controlling a refrigerating unit that includes the steps of providing a freezing compartment, a user interface and a refrigeration circuit with a compressor; and setting a controlling routine through the user interface for avoiding freezer burns on food products to be stored in the freezing compartment, upon the setting changing the set temperature of the freezing compartment to a value from 2° C. to 10° C. lower than the previously set value, and changing the on/off control or the cooling capacity of the compressor so that temperature oscillations in the freezing compartment are limited to a range from 1° C. to 0.1° C.

20 Claims, 2 Drawing Sheets

(56) References Cited

U.S. PATENT DOCUMENTS 7,900,463 B2 3/2011 Barone et al.
8,261,566 B2 * 9/2012 Furlanetto ..... A23L 3/001 62/126
8,899,069 B2 12/2014 Kawamura
8,919,146 B2 12/2014 Ellis et al.
9,506,811 B2 11/2016 Rusnack et al.
2003/0140639 A1 * 7/2003 Gray ..... F25D 21/002 62/157
2003/0182951 A1 * 10/2003 Rafalovich ..... F25D 21/006 62/154
2004/0103674 A1 * 6/2004 Boer ..... F25D 11/022 62/157
2005/0115259 A1 * 6/2005 Ergarac ..... F25D 29/00 62/228.1
2005/0155370 A1 * 7/2005 King ..... F25D 29/00 62/228.1
2006/0233925 A1 * 10/2006 Kawamura ..... A23L 3/32 426/237
2007/0209376 A1 * 9/2007 Boer ..... F25D 21/006 62/155
2007/0227161 A1 * 10/2007 Boer ..... F25D 29/00 62/56
2008/0115511 A1 * 5/2008 Barone ..... F25D 29/00 62/62
2008/0115516 A1 * 5/2008 Pimentel ..... F25D 29/00 62/229
2008/0195256 A1 * 8/2008 Boer ..... F25D 17/065 700/300
2008/0196427 A1 * 8/2008 Bianchi ..... F25D 17/042 62/176.6
2008/0221740 A1 * 9/2008 Boer ..... F25D 29/00 700/300
2011/0219805 A1 * 9/2011 Youn ..... F25D 11/02 62/331
2014/0007608 A1 * 1/2014 Ellis ..... F25D 11/02 62/344
2014/0174100 A1 * 6/2014 Biotti ..... F25B 21/02 62/3.4
2014/0190188 A1 * 7/2014 Li ..... F25D 29/00 62/66
2014/0229137 A1 * 8/2014 Rusnack ..... G01K 1/02 702/130

* cited by examiner

METHOD FOR CONTROLLING A REFRIGERATING UNIT

CROSS-REFERENCE TO RELATED APPLICATION

The present application is a continuation of U.S. patent application Ser. No. 14/686,167 (now U.S. Pat. No. 9,933,204), entitled METHOD FOR CONTROLLING A REFRIGERATING UNIT, which was filed on Apr. 14, 2015, and which claims priority to European Patent Application No. EP 14164547.3, entitled A METHOD FOR CONTROLLING A REFRIGERATION UNIT, which was filed on Apr. 14, 2014, the entire disclosures of which are hereby incorporated by reference.

BACKGROUND

Freezer burn is browning patches visible on the surface of the food stored in the freezing compartment (known also as "freezer") caused by moisture lost by the food. The freezer burn is not dangerous for human health but it is a visible aspect showing a deterioration of the food and usually the user cuts the colored spots and throws them away.

To prevent freezer burn, a correct food wrapping can be suggested in order to avoid evaporation of moisture and escape of moisture from the food.

BRIEF SUMMARY OF THE DISCLOSURE

The present disclosure generally relates to a method for controlling a refrigerating unit comprising a freezing compartment, a user interface and a refrigeration circuit with a compressor, particularly for avoiding or reducing so called freezer burns on food products.

Applicants have carried out a study in order to evaluate how to prevent or reduce the freezer burn by applying a dedicated control of the temperature of the freezer to be used in conjunction to the food wrapping (or in alternatives to that).

Such object is reached thanks to the features listed in the appended claims and discussed in this application.

Applicants have discovered that storage temperature in the freezer and temperature swing (amplitude oscillation around the average stored temperature) and/or of the food are the main control parameters that affect the freezer burn formation. For No-Frost products, the defrosting period is another important parameter to be controlled.

According to the present disclosure, to prevent or reduce the freezer burn formation, the user may engage a controlling routine through a user interface of the appliance on which it is indicated a specific function.

An aspect of the present disclosure is generally directed to a method for controlling a refrigerating unit comprising the steps of: providing a freezing compartment, a user interface and a refrigeration circuit with a compressor; and setting a controlling routine through the user interface for avoiding freezer burns on food products to be stored in the freezing compartment, upon the setting changing the set temperature of the freezing compartment to a value from 2° C. to 10° C. lower than the previously set value, and changing the on/off control or the cooling capacity of the compressor so that temperature oscillations in the freezing compartment are limited to a range from 1° C. to 0.1° C.

Another aspect of the present disclosure is generally directed to a refrigerating unit comprising a freezing compartment, a user interface, a refrigeration circuit with a compressor, and a control unit configured to drive a controlling routine following a command through the user interface for avoiding freezer burns on food products to be stored in the freezing compartment, wherein the controlling routine comprises a change of a set temperature of the freezing compartment to a value from 2° C. to 10° C. lower than a previously set value, and a change of the on/off control or the speed control of the compressor so that temperature oscillations in the freezing compartment are limited to a range from 1° C. to 0.1° C.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
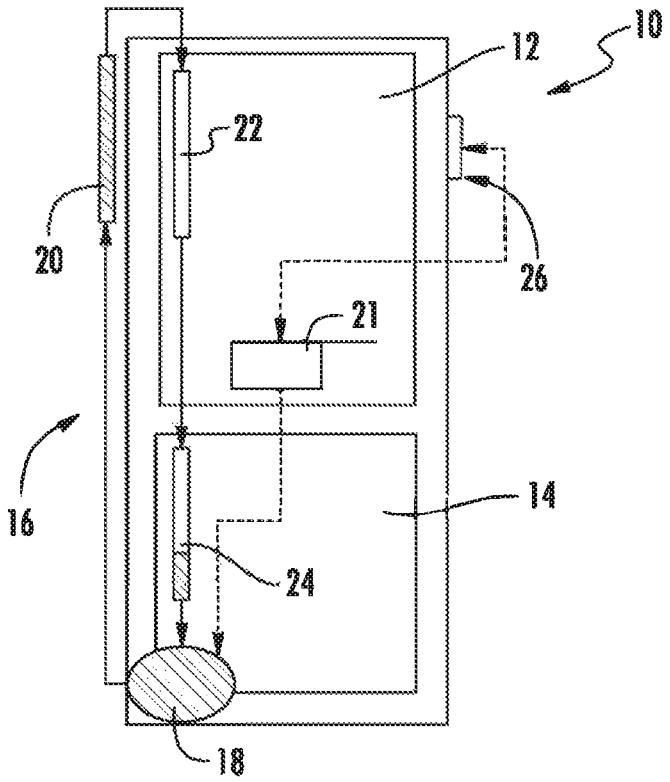
FIG. 1 is a schematic view of a refrigerator according to the invention.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

With reference to the drawings, a refrigerator 10 comprises a refrigerating cavity 12 and a freezing cavity 14. The refrigerator further comprises a refrigerating circuit 16 having a compressor 18, a condenser 20, a first evaporator 22 and a second evaporator 24. The refrigerating circuit may also have different configurations, i.e. with evaporators not in series and/or with three way valves for adjusting the distribution of refrigerant fluid into the evaporators. Moreover, the compressor may be driven on the basis of an on/off methodology or it may be a variable cooling capacity compressor (for example variable speed compressor or linear compressor) where its cooling power is varied in order to maintain a set temperature in the freezing and refrigeration compartments.

According to the invention, the refrigerator comprises a user interface 26 where the user can set a controlling routine designed for avoiding or at least reducing the freezer burns in food product loaded into the freezer 14. The refrigerator 10 also comprises a control process unit 21 which is connected to the compressor 18, to the user interface 26, and to other conventional components of the refrigerator, such as temperature sensors or the like (not shown).

Figure 2:
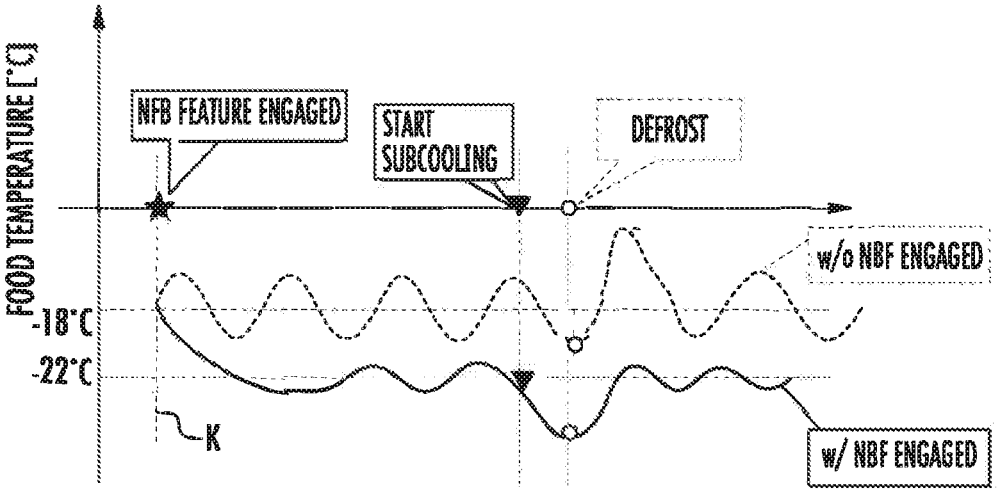
FIG. 2 is a diagram showing how the temperature in the freezer changes when the function "no freezing burns" is activated.

The consequence of the above choice (no freezer burns routine) by the user on the appliance control are evidenced on FIG. 2 and consists of:

Setting a lower temperature with respect to the "standard" freezer temperature setting (−18° C.). In FIG. 2, this new set temperature is indicated as an example at −22° C., Tests carried out by the Applicants have shown that good results can be obtained by decreasing the temperature in a range from 4 degrees Celsius to 8 degrees Celsius lower than the standard temperature setting.

Together with a lower temperature set, a more precise temperature control is needed to avoid possible changing of the moisture state inside the food. As an example, the admitted temperature oscillation on the food is 0.25° C. instead of 1° C. Good results have been obtained in an oscillation range comprised between 0.1 and 0.8° C.

The temperature is kept at this new temperature until the function is disengaged by the user on user interface 26 or, for no-frost appliances, until a de-frosting phase is activated. The de-frosting is needed to eliminate the accumulated frost on the evaporator and for this reason a heater (not shown) is switched ON for a determinate time causing a melting of the frost and, by consequence, as a drawback, an increase in temperature of the food inside the cavity.

For no-frost appliances, it is important to compensate the food warming-up and, for that reason, a sub-cooling phase is engaged prior the defrosting. The sub-cooling temperature may be evaluated according to EP 1565514, the entire contents of which are incorporated by reference herein, where the sub-cooling phase is determined in the same manner as food temperature recovery is executed. In most of the cases, in fact, defrost can be engaged following a door opening event where, most probably, an insertion of the load is done. Under this situation, the appliance control algorithm has to recover the temperature of the inserted food. The time of the sub-cooling phase depends on many factors and, in the easier form, might be a constant value like 30-60 minutes of continuous compressor running at its maximum cooling capacity, but this is not assuring that during the defrosting and with high environmental temperature, the food will not overly warm for a determined time. For this reason an estimation of the external temperature and the food temperature are recommended. A more precise method is to run the compressor until a defined temperature of the freezer evaporator has been reached (i.e. −26° C.). After that, the defrosting can start. This method of sub-cooling is shown in the right portion of FIG. 2, where sub-cooling anticipates the defrosting and ends when defrost starts. In the same figure, the upper curve is referred to as the normal configuration of the freezer, i.e. without the no freezer burns function engaged. The lower curve refers to a condition where the above function is switched on at time K. As the evaporator temperature is affected by the external temperature and the load temperature itself, it is representing an internal and adaptive monitor of the cooling system.

Figure 3:
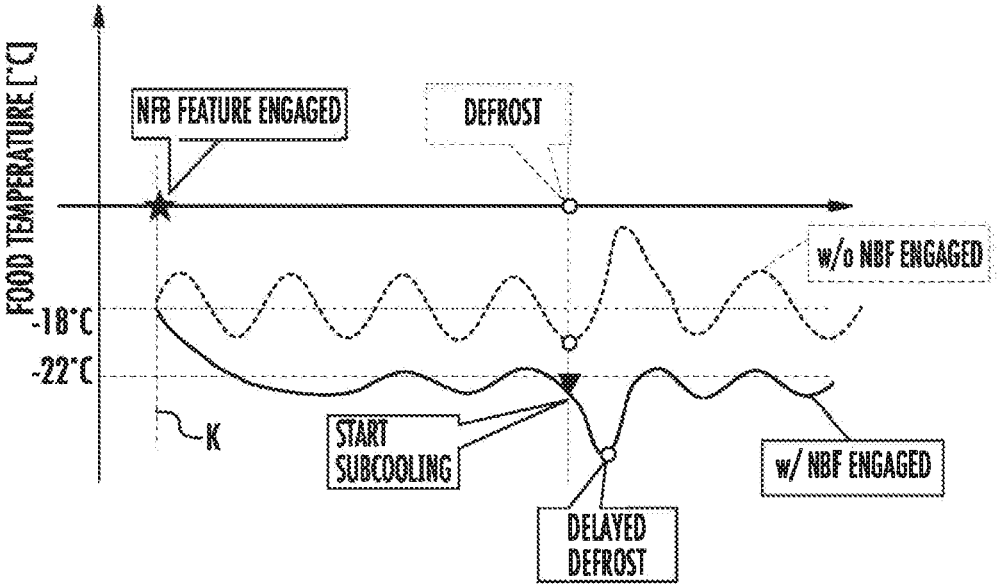
FIG. 3 is a diagram similar to FIG. 2, but showing a different embodiment of the method according to the invention.

FIG. 3 shows a different embodiment of the method according to the invention in which, in case of a no-frost freezer, the sub-cooling starts when defrost is expected, so that defrost is postponed after sub-cooling is concluded.

For assessing food color percent variation as an estimate of the presence of freezer burns, the Applicants have adopted an image analysis, using a visible camera (Q-imaging 0I-QIC-F-CLR-12, TV zoom lens: 1:1-2/12.5-75) and Image Pro Plus software. Intensity of superficial discoloration (due to freezer burns) has been assessed in the value of each pixel. The intensity of each point of the food surface after being frozen is compared to the intensity of fresh food. The sum of the considered points (pixel) represents the food surface that has preserved the original color.

In the food preservation tests, the Applicants have tested different kinds of foods, for instance chicken, hamburger and ice cream (vanilla and chocolate). In particular, the Applicants tested different foods in different packages for long time (2 months) in different conditions, i.e. vacuum packaging, tray and cling film, and a "Cuki" plastic bag. The best result in terms of lack of discoloration have been achieved by reducing the temperature in the freezer 14 at −22° C. with a temperature oscillation on the order of +/−0.5° C. by using trays and plastic bags. With meat packed in a tray, the reduction of meat discoloration when the function "no freezer burns" was activated was about 18% (with about 80% of the surface of meat discolored for "standard" freezing, i.e. −18° C.+/−2°), while for meat packed in a plastic bag the % of the surface with color variation was reduced by 36% (with about 85% of the surface of meat discolored for "standard" freezing).

Freezer burns were on average reduced by 35% when the function is on. The food item that mainly benefited from such technology was red meat. The Applicants have also discovered a frost formation on meat surface which has changed limitedly with temperature.

The following table shows food color percent variation for different working configurations by considering beef steaks in Cuki film for two weeks of storage. The table also identifies the different working conditions as far as air temperature and temperature swing are concerned:

| Test | Air temperature (° C.) | Temperature swing | static | No-frost | Color variation |
|---|---|---|---|---|---|
| A | −18 | +/−2° C. | X | | 65% |
| B | −20 | +/−0.5° C. | | with sub-cooling | 55% |
| C | −22 | +/−0.5° C. | | with sub-cooling | 34% |

From the above table, it is evident how, with a method according to the disclosure, it is possible to obtain a 40-45% reduced color variation (i.e. of area affected by freezer burns) versus the present performances of freezers. In fact, the food surface areas affected by color change(s) are in the range of 30-35% rather than 65%.

A combination of a reduced freezer temperature with narrow temperature fluctuations has shown the best results in terms of freezer burns reduction.

Different technologies for keeping very low the temperature fluctuations in the freezers can be adopted but one of the preferred one is disclosed in the European patent application 12198390 filed by the same Applicants, the disclosure of which is hereby incorporated by reference in its entirety.

What is claimed is:

1. A method of reducing freezer burn of a food product loaded in a freezing cavity of a refrigerator comprising:

presenting a refrigerator with a freezing cavity, a refrigeration circuit in thermal communication with the freezing cavity to maintain the freezing cavity at a first set temperature subject to a first temperature oscillation range, a user interface allowing a user to set a controlling routine to reduce freezer burn of a food product loaded into the freezing cavity;

setting, via the user interface, the controlling routine to reduce freezer burn on the food product loaded into the freezing cavity; and as a result of the setting, maintaining the freezing cavity at a second set temperature subject to a second temperature oscillation range until the user disengages the controlling routine via the user interface;

wherein, the second set temperature is colder than the first set temperature and the second temperature oscillation range is smaller than the first temperature oscillation range.

2. The method of claim 1 further comprising:

wrapping the food product before the food product is loaded in the freezing cavity.

3. The method of claim 1, wherein, the second set temperature is between 2° C. to 10° C. colder than the first set temperature.

4. The method of claim 1, wherein, the second temperature oscillation range is between 0.1° C. and 1° C.

5. The method of claim 1, the refrigeration circuit including a compressor with an on/off control; wherein, changing the on/off control of the compressor results in the second temperature oscillation range rather than the first temperature oscillation range.

6. The method of claim 1, the refrigeration circuit including a variable cooling capacity compressor; wherein, varying the cooling capacity of the variable cooling capacity compressor results in the second temperature oscillation range rather than the first temperature oscillation range.

7. The method of claim 3, wherein, the second set temperature is between 4° C. to 8° C. colder than the first set temperature.

8. The method of claim 1, wherein, the second set temperature is −22° C. or colder.

9. The method of claim 4, wherein, the second temperature oscillation range is between 0.1° C. and 0.8° C.

10. The method of claim 1, the refrigeration circuit further comprising an evaporator, the method further comprising:

reducing a temperature of the freezer cavity to a third set temperature, which is colder than the second set temperature;

defrosting the evaporator after the temperature of the freezer cavity is reduced to the third set temperature; and returning temperature of the freezer cavity to the second set temperature.

11. The method of claim 1 further comprising: packing the food product in a plastic bag, wherein the food product is meat.

12. An apparatus comprising:

a freezing cavity;

a refrigeration circuit in thermal communication with the freezing cavity configured to maintain the freezing cavity at least at a first set temperature subject to a first temperature oscillation range, and at a second set temperature subject to a second temperature oscillation range; and a user interface allowing a user to set a controlling routine to reduce freezer burn of a food product loaded into the freezing cavity;

wherein, when the controlling routine is not set, the refrigeration circuit maintains the freezing cavity at the first set temperature subject to the first temperature oscillation range;

wherein, when the controlling routine is set, the refrigeration circuit maintains the freezing cavity at the second set temperature subject to the second temperature oscillation range until the user disengages the controlling routine via the user interface; and wherein, the second set temperature is colder than the first set temperature and the second temperature oscillation range is smaller than the first temperature oscillation range.

13. The apparatus of claim 12, wherein, the second set temperature is between 2° C. to 10° C. colder than the first set temperature.

14. The apparatus of claim 12, wherein, the second temperature oscillation range is between 0.1° C. and 1° C.

15. The apparatus of claim 12, the refrigeration circuit including a compressor with an on/off control;

wherein, the controlling routine changes the on/off control of the compressor to maintain the freezer cavity at the second set temperature subject to the second temperature oscillation range rather than the first set temperature subject to the first temperature oscillation range.

16. The apparatus of claim 12, the refrigeration circuit including a variable cooling capacity compressor;

wherein, the controlling routine changes the cooling capacity of the variable cooling capacity compressor to maintain the freezer cavity at the second set temperature subject to the second temperature oscillation range rather than the first set temperature subject to the first temperature oscillation range.

17. The apparatus of claim 13, wherein, the second set temperature is between 4° C. to 8° C. colder than the first set temperature.

18. The apparatus of claim 12, wherein, the second set temperature is −22° C. or colder.

19. The apparatus of claim 14 wherein, the second temperature oscillation range is between 0.1° C. and 0.8° C.

20. The apparatus of claim 12, the refrigeration circuit further comprising an evaporator and the refrigeration circuit is further configured to bring a temperature of the freezing cavity to a third set temperature, which is colder than the second set temperature;

wherein, when the controlling routine is set, the refrigeration circuit brings the temperature of the freezing cavity to the third set temperature before defrosting the evaporator and then returns the temperature of the freezing cavity to the second set temperature after the evaporator is defrosted.

* * * * *